US005282118A

United States Patent [19]

Lee

[11] Patent Number: 5,282,118

[45] Date of Patent: Jan. 25, 1994

[54] LIGHTING FIXTURE WITH INTEGRAL MOTION DETECTOR

[75] Inventor: Wade P. Lee, Lafayette, Calif.

[73] Assignee: Intelectron Products Company, Hayward, Calif.

[21] Appl. No.: 994,876

[22] Filed: Dec. 21, 1992

[51] Int. Cl.[5] ..... F21V 23/00

[52] U.S. Cl. ..... 362/276; 362/802

[58] Field of Search ..... 362/276, 802

[56] References Cited

U.S. PATENT DOCUMENTS 5,217,296 6/1993 Tanner et al. ..... 362/802

*Primary Examiner*—Carroll B. Dority

[57] ABSTRACT

A lighting fixture with infra-red responsive motion detector unit incorporated into the fixture design. The lighting fixture includes a motion detector housing forming an integral part of the lighting fixture body and having a generally convexo-convex shape fitting in with the decorative styling of the fixture body. The bottom portion of the housing has an upwardly curving bottom wall containing an azimuthally extending lens aperture. A plastic lens member is positioned in the lens aperture and is formed to conform to the curvature of the convex bottom wall so that the lens member appears to form a continuous portion of the wall. The lens member defines a plurality of Fresnel lenses which are disposed to direct infra-red radiation from an object in their aggregate field of view to an infra-red sensor mounted within the housing. The housing is incorporated into the body of the lighting fixture itself, instead of being mounted on a separate mounting base, and is disposed on the lighting fixture such that no other portion of the lighting fixture obstructs the aggregate field of view of the plurality of Fresnel lenses.

7 Claims, 3 Drawing Sheets

LIGHTING FIXTURE WITH INTEGRAL MOTION DETECTOR

BACKGROUND OF THE INVENTION

The present invention relates to infra-red motion detectors of the type used in residential outside lighting, for example, to illuminate a walkway or driveway when a person or automobile approaches.

Lighting devices responsive to the infra-red radiation emitted by humans or motor vehicles have been known for some time. These devices turn on a light when they receive infra-red radiation from a person or vehicle moving in the field of view of the device. Such lighting devices are desirable because they improve safety by automatically providing a lighted path for approaching guests, they save energy by automatically turning off the lights when no one is nearby, and they improve security by illuminating the area when an unwanted intruder approaches. The devices are coupled to a motion detector unit which includes a sensor responsive to infra-red radiation and an arrangement of lenses or mirrors for directing infra-red radiation from an approaching person or object to the sensor. The motion detector with its lenses or mirrors must be positioned in full view of the area to be monitored so that the device can "see" approaching persons or other target objects.

The typical lighting fixture by the front door of a house is decoratively designed, often characteristic of a particular stylistic period complementing the style of the house. The motion detector unit in known decorative lighting fixtures is a self-contained unit mounted in the vicinity of the lighting fixture as an adjunct to the fixture. Typically an extra mounting base is supplied to hold the motion detector unit and associated circuitry, and the lighting fixture is separately mounted on the mounting base.

FIG. 1 illustrates the problems in mounting a decorative lighting fixture with motion detector unit according to known practice. A mounting base 10, illustrated in phantom, is mounted on an exterior sidewall of a house located, for example, by the front door. A motion detector unit 11 (also shown in phantom) and lighting fixture 12 are mounted on base 10. A first problem with this mounting method is that an extra mounting base 10 must be supplied with the lighting fixture, which adds to the inventory of parts that must be maintained and amount of the product packaging. Another problem evident from FIG. 1 is that not all lighting fixtures can be functionally mounted in this manner. The lighting fixture illustrated in FIG. 1, for example, is a popular design including a long, downwardly extending, decorative tail piece 13. In the conventional mounting method the tail piece necessarily obstructs the field of view, indicated at reference numeral 14, of motion detector unit 11. Thus, the conventional method may practically be used only with lighting fixtures of limited outline leaving a clear area for the motion detector field of view. To avoid this problem, mounting base 10 may of course be made larger to extend beyond the lighting fixture outline, but this results in an undesirable tradeoff. To the supplier or producer of the lighting fixtures, providing a larger mounting base sufficient to avoid the lamp outline calls for yet a greater parts inventory to match a variety of lamp outlines, calls for more product packaging, and ultimately increases the cost of the fixture. To the consumer the necessity of a larger mounting base highlights another problem with the conventional mounting method. A conventional mounting base and motion detector unit do not generally conform to the style of the lighting fixture. The base and motion detector unit can appear incongruent and out of place because they do not follow the lines of the fixture design or because they visibly impose an unwanted piece of twentieth-century electronics into an old-world lamp design.

SUMMARY OF THE INVENTION

The present invention provides a lighting fixture with motion detector that overcomes the deficiencies noted above. The invention provides a lighting fixture that incorporates the motion detector unit into the fixture design itself in a decorative manner and avoids the need for a separate mounting base for the motion detector unit.

Briefly, a lighting fixture in accordance with the invention includes a motion detector housing forming an integral part of the lighting fixture body. The motion detector housing has a generally convexo-convex shape which is styled to fit in with the decorative styling of the fixture body. The bottom portion of the housing has an upwardly curving bottom wall containing an azimuthally extending lens aperture. A plastic lens member is positioned in the lens aperture and is formed to conform to the curvature of the convex bottom wall so that the lens member appears to form a continuous portion of the wall. The lens member defines a plurality of Fresnel lenses which, despite the curvature of the bottom wall and conforming lens member, are disposed to direct infra-red radiation from an object in their aggregate field of view to an infra-red sensor mounted within the housing. The housing is incorporated into the body of the lighting fixture itself, instead of being mounted on a separate mounting base, and is disposed on the lighting fixture such that no other portion of the lighting fixture obstructs the aggregate field of view of the plurality of Fresnel lenses.

A further understanding and appreciation of the nature and advantages of the invention will be gained by reference to the remaining portion of the specification and to the accompanying drawings.

DETAILED DESCRIPTION OF AN ILLUSTRATIVE EMBODIMENT

Figure 1:
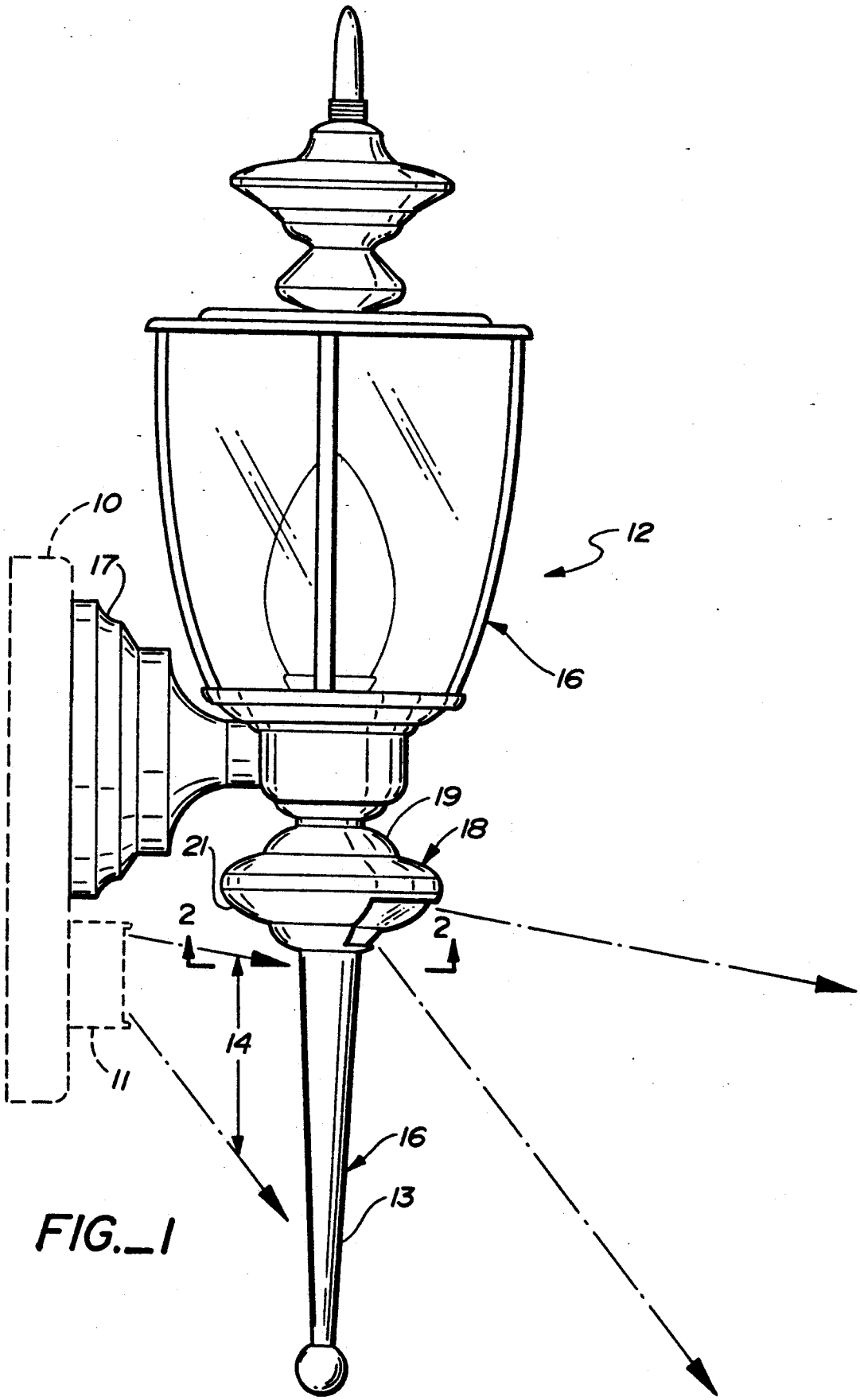
FIG. 1 is an elevational view of a lighting fixture embodying the present invention, also showing a prior art mounting method in phantom.
Figure 2:
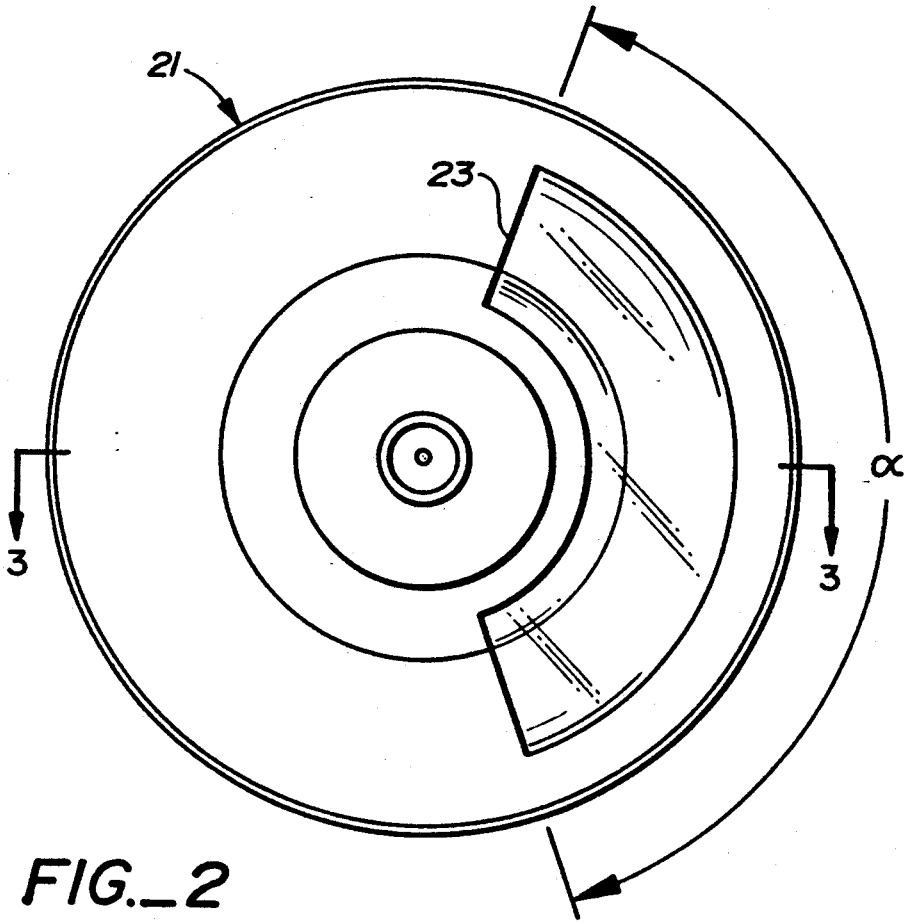
FIG. 2 is a bottom view of the motion detector housing viewed in the direction 2—2 in FIG. 1.

FIG. 1 shows a lighting fixture 12 according to the present invention including a decorative fixture body 16 and mounting portion 17 for mounting the fixture on a wall. Lighting fixture body 16 includes a motion detector housing 18 as an integral part of the body. Motion detector housing 18 is composed of a generally convex upper portion 19 and a generally convex lower portion 21, which together give the housing a generally convex-o-convex shape. Included within housing 18 is one or more infra-red sensors 22 positioned generally in the upper half of the housing. (See FIG. 3.) The bottom portion 21 of housing 18 defines an azimuthally extending lens aperture 23. As used here "azimuthal extent" refers to the measurement of angle relative to the rotational symmetry of the housing as viewed in FIG. 2. The angular extent of the lens aperture opening is designated $\alpha$ in FIG. 2. An angular extent of 140 degrees is shown here, which is adequate for a typical fixture mounted by the front door of a house. Positioned in lens aperture 23 is a plastic lens member 24 with a plurality of Fresnel lenses 26 formed on the inner surface of lens member 24. The Fresnel lenses direct infra-red radiation from a target object to sensor 22 and define a plurality of individual fields of view. The aggregate of these individual fields of view define the overall field of view of the device. Fresnel lenses 26 and one or more sensors 22 are arranged to function with one another in motion detection relation for triggering the light of fixture 12 when a warm body is within range. While this functional relationship is common in known passive infra-red motion detectors, it is achieved here in a housing that would otherwise be considered to present an inhospitable geometry for achieving a practical motion detector arrangement with adequate field of view aimed in a meaningful direction.

Figure 3:
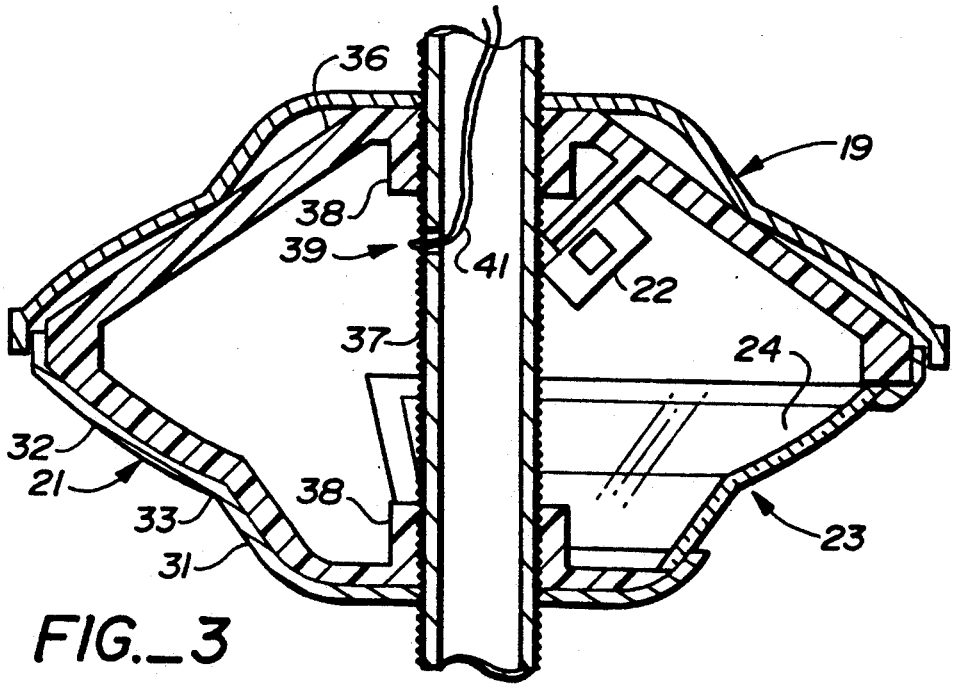
FIG. 3 is a cross-sectional view of the motion detector housing along the line 3—3 in FIG. 2.
Figure 4:
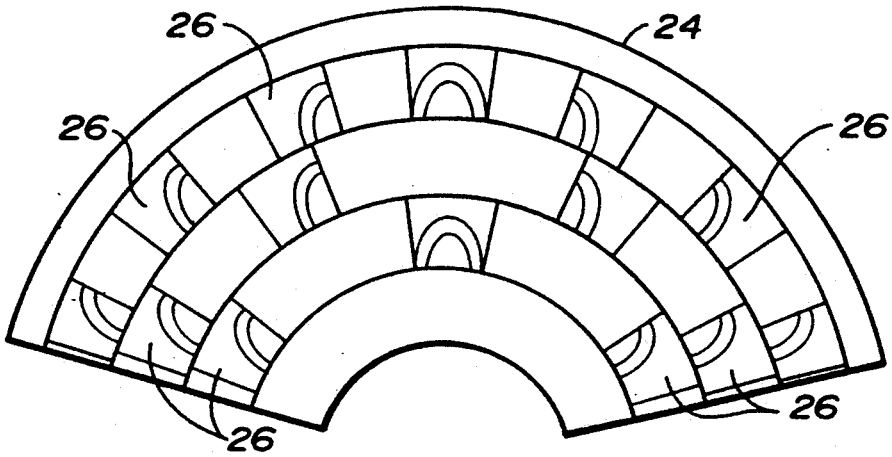
FIG. 4 is a plan view of the inner surface of a lens member showing the Fresnel lenses.

In the illustrated embodiment the motion detector housing is of a generally flattened convexo-convex shape, meaning that the housing has an overall oblate or "flattened" appearance with both the top and bottom portions generally curving outwardly and the vertical extent of the housing being less than its horizontal extent. The top and bottom portions may be formed with one smoothly curved section or with two or more sections of different curvature profiles such as illustrated in FIG. 3 at reference numerals 31 and 32 joined at boundary edges such as 33 to give an overall stepped appearance. Such shapes are referred to herein generally as "saucer shaped." The motion detector housing is generally convexo-convex in shape to provide adequate space within for apparatus to mount one or more sensors 22 as well as apparatus to secure the housing to the fixture body while at the same time allowing sufficient room to allow for the focal lengths of the plurality of Fresnel lenses. While the saucer-shaped housing places even more stringent limitations on the available space within the housing and the curved wall of the bottom portion of the housing limits the positioning of the Fresnel lenses, it has been discovered that even here a practical motion detector arrangement may nevertheless be achieved. This is particularly desirable because saucer-shaped members are common decorative design elements of fashionable lighting fixtures, and the rectilinear motion detector housings of the prior art commonly used with such lighting fixtures destroy the artistic integrity of the fixture designs.

Figure 5:
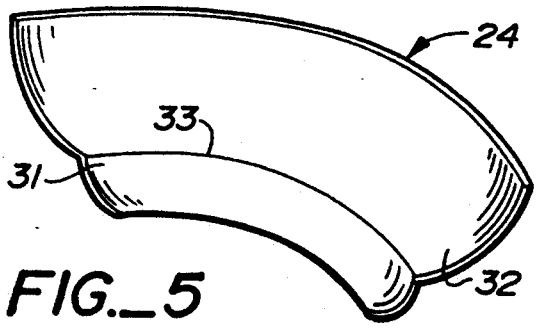
FIG. 5 is a perspective view of a the exterior surface of a lens member having a compound curvature.

The disposition and arrangement of Fresnel lenses 26 and lens member 24 may be understood as follows. As commonly deployed in known passive infra-red motion detectors, a plurality of individual Fresnel lenses, sometimes referred to as lens facets or lens segments, are formed on a thin plastic sheet, which is then positioned in front of the infra-red sensor or sensors. In known motion detectors the plastic lens member sheet is deployed in a flat configuration or is bent slightly to give it a slight cylindrical form. The individual lens segments are formed and balanced with respect to one another on the sheet so that when the sheet is in position in front of the sensors, the lens segments define individual fields of view of appropriate size and sensitivity aimed in the desired directions and concentrating infra-red radiation on the sensors. In the present case the plastic lens member sheet is pre-formed to conform to the curvature of the housing bottom portion. That is, the pre-formed plastic sheet generally follows the curvature of the housing bottom portion and continues that curvature into lens aperture 23. Because of the convexo-convex shape of the motion detector housing, the housing bottom portion will curve in two directions as it mates with the housing top portion so that the plastic lens sheet will have to be pre-formed with a corresponding curvature in two directions, unlike the flat or cylindrical sheet commonly found in motion detectors. Continuing the housing bottom curvature into aperture 23 in this manner helps to disguise or camouflage the lens member. The lens member may also be tinted to correspond at least approximately to the color of the housing bottom portion to camouflage the lens member further so that it is even less likely to disrupt the lines of the lamp design. Pre-formed two-dimensionally curved tinted lens members with appropriate Fresnel lens segments formed on the inner surface may be fabricated, for example, by Fresnel Technologies Inc. of Fort Worth, Tex. A variety of curvatures and curvature combinations may be produced such as illustrated at reference numerals 33 and 34 in FIG. 5, and resulting housings may be produced to fit in with any number of desired lamp designs from the simplicity of classical designs to the ornate complexity of baroque designs.

As illustrated in FIG. 3, housing 18 contains a support member 36 for mounting sensor 22 and for maintaining lens member 24 in position at lens aperture 23. A threaded hollow rod 37 runs through housing 18, and support member 36 is formed with two collars 38 for receiving rod 37. Such rods are commonly used in lighting fixtures to provide structural integrity and rigidity. In the embodiment of FIG. 1, for example, the lower portion of threaded rod 37 extends through the elongate decorative cylindrical tail piece 13 to hold the tail piece to the motion detector housing. Rod 37 is provided with a feedthrough opening 39 for electrical leads 41 from sensor 22 and any other motion detector circuitry included within the housing to the main circuitry for energizing the light.

Figure 6:
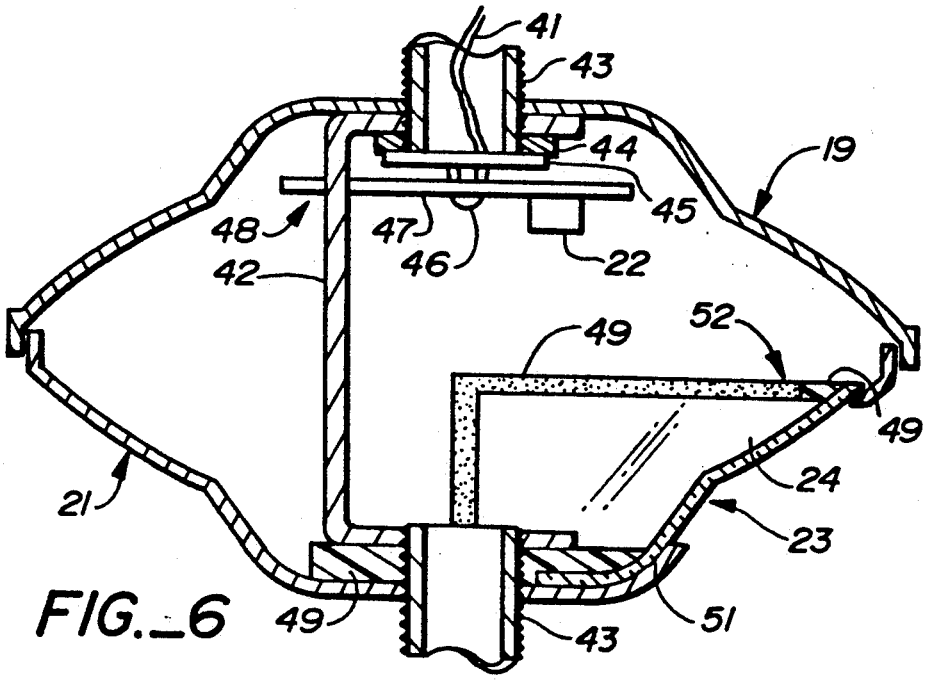
FIG. 6 is a cross-sectional view of an alternative motion detector housing configuration.

Those skilled in the art will recognize that other equivalent mechanical arrangements may be provided for securing the sensor and lens member while providing a conduit for the electrical leads and preserving structural integrity. Such an alternative construction is shown in FIG. 6, which employs a metal "C"-shaped support bracket 42 instead of the continuous, apertured rod 37 of FIG. 3. The threaded rod 43 terminates at each end of the housing where it is connected to the C-bracket 42. At the upper position bracket 42 is secured by nut 44 screwed onto the end of rod 43. Mounted on bracket 42 by off-center bolts 46 is a printed circuit board 47 with some of the motion detector electronics. The circuit board may be spaced apart from nut 44 by spacers 45. Infra-red sensor 22 is mounted on the printed circuit board. One end of circuit board 47 is provided with a cutout at reference numeral 48 to allow for bracket 42. In this way sensor 22 may be mounted farther back from the array of Fresnel lenses, which allows for a wider instrument field of view for a fixed size lens aperture. The lens aperture 23 and lens member 24 are the same as in FIG. 3. The lens member is held in position by a plastic lens frame 49, which seats over the bottom portion of lens member 24 as indicated at reference numeral 51 and presses against the upper portion of lens member 24 at reference numeral 52. Lens frame 49 is secured in position by the bottom portion of C-bracket 42, which has as threaded aperture for receiving threaded rod 43.

The above arrangement overcomes the obstruction problem, in which a lighting fixture such as illustrated in FIG. 1 having a long vertical reach, from the lower extremity of tailpiece 13 to the upper extremity of the top decorative member, blocks the field of view of a motion detector unit placed in any convenient location behind the lighting fixture.

The above descriptions and drawings disclose illustrative embodiments of the invention. Given the benefit of this disclosure, those skilled in the art will appreciate that various modifications, alternate constructions, and equivalents may also be employed to achieve the advantages of the invention. For example, as described above the lens aperture and lens member are contained in the bottom portion of the motion detector housing. This is the typical configuration for a lighting fixture to be mounted by a door at eye level or higher so that the field of view will generally project out and downwards. In some uses, however, such as walkway lights lining a walkway and positioned one or two feet off the ground, the field of view will preferably project out and upwards. Those skilled in the art will recognize that in such applications the motion detector housing may be installed upside down from the above description. Thus, the lens aperture and lens member may equivalently be provided in the top portion of the housing so that the role of the top and bottom portions of the housing will be reversed. As an additional example, in the embodiment disclosed above Fresnel lenses 26 concentrate infra-red radiation from their respective fields of view directly to sensor 22. Those skilled in the art will appreciate that other optical arrangements not described here are also possible employing reflecting surfaces or other lens members in addition to the Fresnel lenses for more circuitously directing infra-red radiation to the sensor. Thus, the invention is not to be limited to the above description and illustrations, but is defined by the appended claims.

What is claimed is:

1. A lighting fixture actuated by an infra-red sensing motion detector, the lighting fixture having a decorative fixture body and comprising.

a motion detector housing located within said decorative fixture body and disposed to form an integral part of said decorative fixture body, said housing having a generally curved convexo-convex shape and comprising a generally convex bottom portion and a generally convex top portion defining convexo-convex shape;

wherein said generally convex bottom portion has an upwardly curving bottom wall with an azimuthally extending lens aperture formed therein;

an infra-red sensor responsive to infra-red radiation mounted within said housing in view of said lens aperture;

a plastic lens member covering said lens aperture and formed to conform to the curvature of said generally convex bottom portion, said lens member having a plurality of fresnel lenses formed on the inner surface thereof and disposed to direct infra-red radiation to said sensor; and wherein said motion detector housing is disposed on said decorative fixture body such that no portion of said decorative fixture body obstructs the fields of view of said plurality of fresnel lenses.

2. The apparatus of claim 1 wherein said motion detector housing bottom portion and top portion are generally saucer-shaped.

3. The apparatus of claim 2 wherein said bottom portion has a compound curvature and said lens member generally conforms to said compound curvature.

4. The apparatus of claim 1 wherein at least the outwardly facing surface of said plastic lens member is colored generally to blend in with the color of said housing bottom portion, whereby the curvature and color of said lens member camouflage said lens member in said housing.

5. The apparatus of claim 1 wherein said fixture body includes an elongate vertical decorative member and said motion detector housing is mounted thereon centrally disposed about the longitudinal axis thereof.

6. The apparatus of claim 5 wherein said elongate decorative member contains a central rod, said rod extends through said housing top and bottom portions so as to mount said motion detector housing on said rod, and said sensor is mounted off-center with respect to said rod.

7. The apparatus of claim 1 further comprising a C-shaped bracket wherein one end of said bracket is secure to said housing top portion and the other end of said bracket is secured to said housing bottom portion.

* * * * *